US011646510B2

(12) United States Patent
Morello et al.

(10) Patent No.: US 11,646,510 B2
(45) Date of Patent: May 9, 2023

(54) SHIELDING ELECTRICAL TERMINAL WITH KNURLING ON INNER CONTACT WALLS

(71) Applicant: Aptiv Technologies Limited, St. Michael (BB)

(72) Inventors: John R. Morello, Warren, OH (US); James M. Rainey, Warren, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 60 days.

(21) Appl. No.: 17/243,844

(22) Filed: Apr. 29, 2021

(65) Prior Publication Data

US 2022/0352655 A1 Nov. 3, 2022

(51) Int. Cl.
*H01R 9/05* (2006.01)
*H01R 43/16* (2006.01)

(52) U.S. Cl.
CPC ..... *H01R 9/0524* (2013.01); *H01R 43/16* (2013.01)

(58) Field of Classification Search
CPC . H01R 9/05; H01R 9/24; H01R 43/16; H01R 9/0524
USPC ..... 439/578
See application file for complete search history.

(56) References Cited

U.S. PATENT DOCUMENTS 3,228,207 A 1/1966 Hartmann et al.
3,966,292 A * 6/1976 Schultz ..... H01R 24/40 439/578
4,377,320 A * 3/1983 Lathrop ..... H01R 24/40 439/585
4,412,717 A * 11/1983 Monroe ..... H01R 9/0518 439/582
4,453,796 A * 6/1984 Monroe ..... H01R 9/0518 439/585
5,186,664 A 2/1993 Abe
5,588,884 A 12/1996 Rudoy et al.
5,681,190 A 10/1997 Childs
5,911,605 A 6/1999 Wooldridge et al.
6,007,345 A 12/1999 Francis et al.
6,139,376 A 10/2000 Ooya et al.
6,372,991 B1 4/2002 Myers
6,517,379 B2 2/2003 Leve
(Continued)

FOREIGN PATENT DOCUMENTS

DE 102012201565 A1 * 8/2012 ..... H01R 13/5804
EP 0052980 A2 6/1982
(Continued)

OTHER PUBLICATIONS

Extended European Search Report for EP Application No. 21189004.1, dated Dec. 23, 2021, 8 pages.
(Continued)

*Primary Examiner* — Peter G Leigh
(74) *Attorney, Agent, or Firm* — Billion & Armitage

(57) ABSTRACT

A shielding electrical terminal is presented herein. The shielding electrical terminal includes a securing portion that is configured to attach to an outer shield conductor of a shielded cable and a cylindrical mating portion having an inner surface configured to make electrical contact with a corresponding cylindrical shield terminal inserted within the mating portion. The inner surface of the mating portion defines a plurality of protrusions that extend from the inner surface.

18 Claims, 8 Drawing Sheets

(56) References Cited

U.S. PATENT DOCUMENTS

| | | | | |
|---|---|---|---|---|
| 6,692,316 | B2 | 2/2004 | Hsieh et al. | |
| 7,056,148 | B2 | 6/2006 | Staniszewski et al. | |
| 7,195,505 | B1 | 3/2007 | Becker | |
| 7,204,728 | B2 | 4/2007 | Noro et al. | |
| 7,241,189 | B2 | 7/2007 | Mohs et al. | |
| 7,252,559 | B1 | 8/2007 | Morello et al. | |
| 7,845,993 | B2 | 12/2010 | Falchetti | |
| 8,128,441 | B2 | 3/2012 | Mukuno | |
| 8,167,636 | B1 | 5/2012 | Montena | |
| 8,303,355 | B2 | 11/2012 | Ono et al. | |
| 8,366,483 | B2 * | 2/2013 | Hardy | H01R 9/0518 439/585 |
| 8,485,853 | B2 * | 7/2013 | Seifert | H01R 4/188 439/882 |
| 8,622,774 | B2 * | 1/2014 | Seifert | H01R 4/185 439/882 |
| 8,827,754 | B2 | 9/2014 | Lee et al. | |
| 9,118,130 | B1 | 8/2015 | Volpone et al. | |
| 9,450,352 | B2 * | 9/2016 | Miyawaki | H01R 24/44 |
| 9,455,504 | B2 | 9/2016 | Kim et al. | |
| 9,537,231 | B2 * | 1/2017 | Hall | H01R 13/434 |
| 9,559,467 | B1 | 1/2017 | Khorrami et al. | |
| 9,590,340 | B2 | 3/2017 | Blumenschein et al. | |
| 9,608,427 | B2 | 3/2017 | Fulponi et al. | |
| 9,647,368 | B2 * | 5/2017 | Davies | H01R 13/11 |
| 9,667,000 | B1 * | 5/2017 | Morello | H01R 24/38 |
| 9,673,578 | B1 * | 6/2017 | Lane | H01R 13/631 |
| 9,748,683 | B2 | 8/2017 | Tsuru | |
| 9,966,683 | B2 | 5/2018 | Sasaki et al. | |
| 9,970,121 | B2 | 5/2018 | Ochi et al. | |
| 9,991,650 | B2 * | 6/2018 | Lane | H01R 24/40 |
| 10,090,608 | B2 | 10/2018 | Lewis | |
| 10,103,469 | B1 | 10/2018 | Humphrey et al. | |
| 10,177,517 | B1 | 1/2019 | Lewis et al. | |
| 10,224,647 | B2 | 3/2019 | Hamada et al. | |
| 10,224,658 | B2 | 3/2019 | Marsh et al. | |
| 10,230,191 | B2 | 3/2019 | Lui et al. | |
| 10,256,560 | B2 | 4/2019 | Fertig et al. | |
| 10,290,965 | B1 | 5/2019 | Morello et al. | |
| 10,424,849 | B2 | 9/2019 | Staab et al. | |
| 10,516,238 | B2 | 12/2019 | Lee et al. | |
| 10,532,628 | B2 | 1/2020 | Wang et al. | |
| 10,741,975 | B2 | 8/2020 | Jones et al. | |
| 2001/0039145 | A1 | 11/2001 | Schaefer et al. | |
| 2002/0025732 | A1 | 2/2002 | Hsieh | |
| 2002/0055297 | A1 | 5/2002 | Feeny | |
| 2003/0060090 | A1 | 3/2003 | Allgood et al. | |
| 2005/0266727 | A1 | 12/2005 | Yamaguchi et al. | |
| 2008/0293287 | A1 | 11/2008 | Zinn | |
| 2010/0151748 | A1 | 6/2010 | Kato et al. | |
| 2011/0097928 | A1 | 4/2011 | Burris et al. | |
| 2011/0124247 | A1 | 5/2011 | Okamura et al. | |
| 2012/0108113 | A1 | 5/2012 | Yamaguchi et al. | |
| 2012/0156947 | A1 | 6/2012 | Tyler | |
| 2014/0182931 | A1 | 7/2014 | Furukawa | |
| 2016/0344127 | A1 * | 11/2016 | Drew | C25D 5/605 |
| 2016/0380375 | A1 * | 12/2016 | Saller | H01R 13/46 439/519 |
| 2018/0358757 | A1 | 12/2018 | Lee et al. | |
| 2020/0119495 | A1 | 4/2020 | Bredbeck et al. | |

FOREIGN PATENT DOCUMENTS

| | | | | |
|---|---|---|---|---|
| EP | 0657961 | A2 | 6/1995 | |
| EP | 2006958 | A2 | 12/2008 | |
| EP | 2752945 | A2 | 7/2014 | |
| FR | 2806216 | B1 | 8/2003 | |
| JP | 2003163058 | A * | 6/2003 | H01R 24/44 |
| JP | 2003297493 | A * | 10/2003 | H01R 13/4361 |
| JP | 2008198530 | A | 8/2008 | |
| JP | 5375574 | B2 | 12/2013 | |
| WO | 2016187089 | A1 | 11/2016 | |

OTHER PUBLICATIONS

Extended European Search Report for EP Application No. 21186700.7, dated Dec. 20, 2021, 9 pages.

Final Office Action for U.S. Appl. No. 16/940,619 dated Apr. 22, 2022, 16 pages.

Extended European Search Report for EP Application No. 22170524.7, dated Sep. 20, 2022, 11 pages.

European Patent Office, "Communication Pursuant to EPC Rule 69 dated Nov. 7, 2022", 2 Pages.

China National Intellectual Property Administration, "Notice of Publication dated Nov. 7, 2022", Nov. 1, 2022, 1 Page.

* cited by examiner

SHIELDING ELECTRICAL TERMINAL WITH KNURLING ON INNER CONTACT WALLS

This patent application is directed to a shielding electrical terminal suitable for electrically interconnecting a shielded electrical cable, particularly a shielding electrical terminal with knurling on inner contact walls.

BACKGROUND

Electrical contact between terminals, such as the shielding electrical terminals used to terminate the shield conductors of shielded electrical cables, e.g., coaxial cable, typically relies on the creation of a contact force between the terminals. Shielding electrical terminals typically use one or several spring contacts arms to provide the contact force between the terminals. However, this arrangement usually provides a few small electrical contact points between the male and female shield terminals. Additionally, mechanical vibration between the respective components can cause fretting at the point of contact, eventually resulting in a loss or degradation, e.g., increase electrical resistance, of the electrical contact as the conductive material is worn away at the few small electrical contact points. To combat this problem, complex geometries associated with the electrical contacts can be utilized to ensure additional points of contact. However, the added complexity increases the time and cost associated with manufacturing the electrical contact.

It would be beneficial to develop an electrical contact that provides a cost-effective system for increasing the number of contact points between the respective terminals while maintaining electrical contact in the presence of mechanical vibration/fretting and minimizing an air gap between the respective terminals.

SUMMARY

According to one or more aspects of the present disclosure, a shielding electrical terminal includes a securing portion configured to attach the shielding electrical terminal to an outer shield conductor of a shielded cable and a cylindrical mating portion having an inner surface configured to make electrical contact with a corresponding cylindrical shield terminal inserted within the mating portion. The inner surface defines a plurality of protrusions extending from the inner surface.

In one or more embodiments of the shielding electrical terminal according to the previous paragraph, the plurality of protrusions is non-uniform in height.

In one or more embodiments of the shielding electrical terminal according to any one of the previous paragraphs, the inner surface defines a knurled surface having a plurality of recesses and wherein the plurality of protrusions is arranged on perimeter edges of the plurality of recesses.

In one or more embodiments of the shielding electrical terminal according to any one of the previous paragraphs, each recess in the plurality of recesses is rhombus shaped.

In one or more embodiments of the shielding electrical terminal according to any one of the previous paragraphs, major axes of the plurality of rhombus shaped recesses are aligned generally parallel to a longitudinal axis of the shielding electrical terminal and minor axes of the plurality of rhombus shaped recesses are aligned generally perpendicular to a longitudinal axis of the shielding electrical terminal.

In one or more embodiments of the shielding electrical terminal according to any one of the previous paragraphs, an outer wall of the mating portion is continuous and does not define an aperture extending therethrough.

In one or more embodiments of the shielding electrical terminal according to any one of the previous paragraphs, an outer wall of the mating portion defines an axial slit aligned parallel to a longitudinal axis of the shielding electrical terminal.

In one or more embodiments of the shielding electrical terminal according to any one of the previous paragraphs, the mating portion and the securing portion are formed of a sheet of metal. A thickness of the sheet of metal forming the mating portion is equal to a thickness of the sheet of metal forming the securing portion.

In one or more embodiments of the shielding electrical terminal according to any one of the previous paragraphs, the mating portion is formed from a first sheet of metal and the securing portion is formed of a second sheet of metal. A thickness of the first sheet of metal is less than a thickness of the second sheet of metal.

In one or more embodiments of the shielding electrical terminal according to any one of the previous paragraphs, the plurality of protrusions is sized, shaped, and arranged to minimize an air gap formed between the inner surface of the mating portion and the corresponding cylindrical shield terminal inserted when inserted within the mating portion.

According to one or more aspects of the present disclosure, a method of forming a shielding electrical terminal is presented. The shielding electrical terminal formed by this method has a mating portion configured to make electrical contact with a corresponding cylindrical shield terminal inserted within the mating portion and a securing portion configured to attach the shielding electrical terminal to an outer shield conductor of a shielded cable. The method includes the steps of:

a) forming a terminal preform from a first sheet of metal;
b) forming a plurality of protrusions in a surface of the terminal preform such that the plurality of protrusions extends from the surface; and
c) rolling the terminal preform into cylindrical shape, thereby forming the mating portion which has an inner surface configured to make electrical contact with a corresponding cylindrical male shield terminal inserted within the mating portion, wherein the surface is an inner surface of mating portion.

In one or more embodiments of the method according to the previous paragraph, plurality of protrusions is formed such that it is non-uniform in height.

In one or more embodiments of the method according to any one of the previous paragraphs, step b), forming a plurality of protrusions in a surface of the terminal preform such that the plurality of protrusions extends from the surface, further includes the step of:

d) forming a plurality of recesses in the surface such that the plurality of protrusions is arranged on perimeter edges of the plurality of recesses.

In one or more embodiments of the method according to any one of the previous paragraphs, the plurality of protrusions and the plurality of recesses is formed using a knurling process.

In one or more embodiments of the method according to any one of the previous paragraphs, each recess in the plurality of recesses is rhombus shaped. The plurality of recesses is formed such that major axes of the plurality of rhombus shaped recesses are generally aligned parallel to a longitudinal axis of the shielding electrical terminal and the plurality of recesses is formed such that minor axes of the plurality of rhombus shaped recesses are aligned generally perpendicular to a longitudinal axis of the shielding electrical terminal.

In one or more embodiments of the method according to any one of the previous paragraphs, an outer wall of the mating portion is continuous and does not define an aperture extending therethrough.

In one or more embodiments of the method according to any one of the previous paragraphs, an outer wall of the mating portion defines an axial slit aligned parallel to a longitudinal axis of the shielding electrical terminal.

In one or more embodiments of the method according to any one of the previous paragraphs, the method further includes the step of:

e) forming a securing portion from the first sheet of metal, wherein a thickness of the mating portion is equal to a thickness of the securing portion.

In one or more embodiments of the method according to any one of the previous paragraphs, the method further includes the step of:

f) forming a securing portion from a second sheet of metal, wherein a thickness of the first sheet of metal forming the mating portion is less than a thickness of the second sheet of metal forming the securing portion.

In one or more embodiments of the method according to any one of the previous paragraphs, the method further includes the step of:

g) inserting the corresponding cylindrical shield terminal within the mating portion, wherein the plurality of protrusions is sized, shaped, and arranged to minimize an air gap formed between the inner surface of the mating portion and the corresponding cylindrical shield terminal.

DESCRIPTION OF THE DRAWINGS

The present invention will now be described, by way of example with reference to the accompanying drawings, in which.

Figure 1:
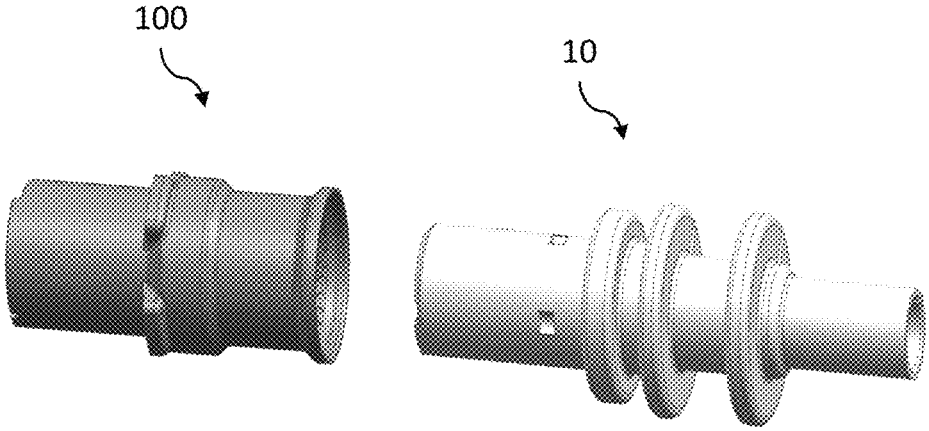
FIG. 1 is a perspective view of a shielding electrical terminal and a corresponding mating shielding electrical terminal according to some embodiments.
Figure 2:
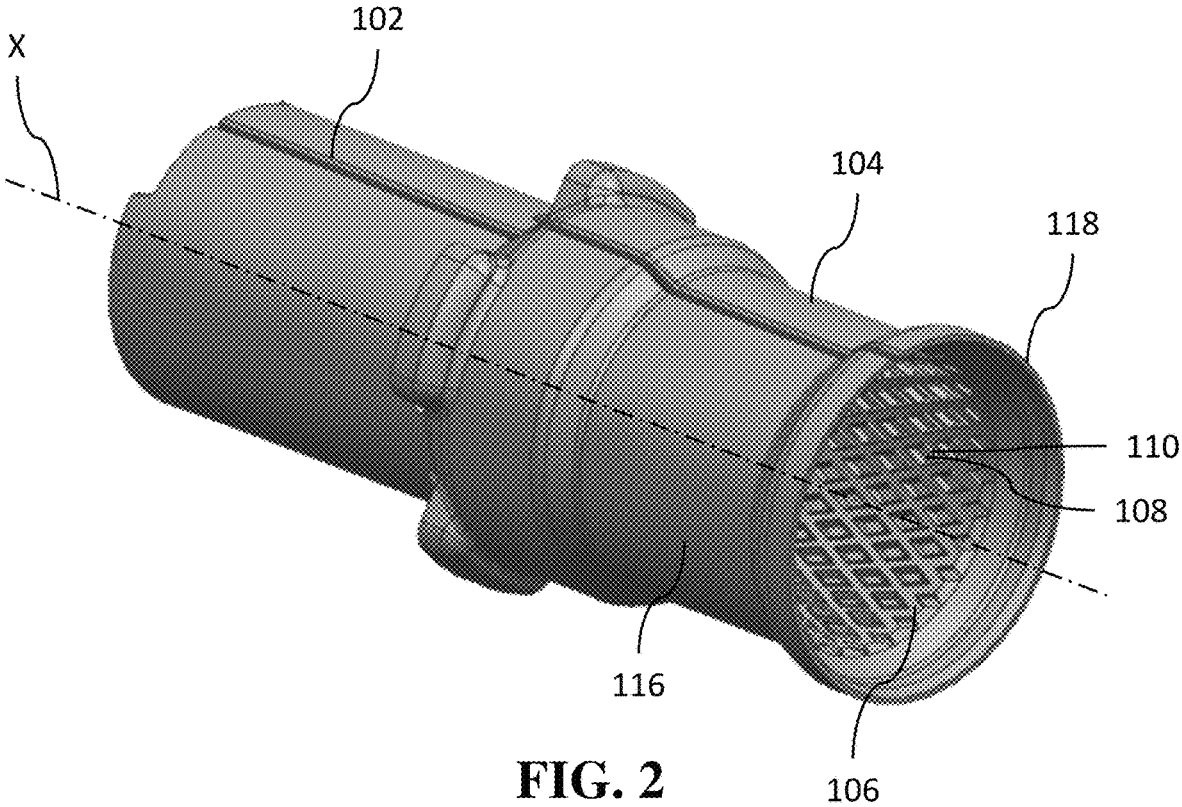
FIG. 2 is a partial perspective view of the shielding electrical terminal of FIG. 1 according to some embodiments.
Figure 3:
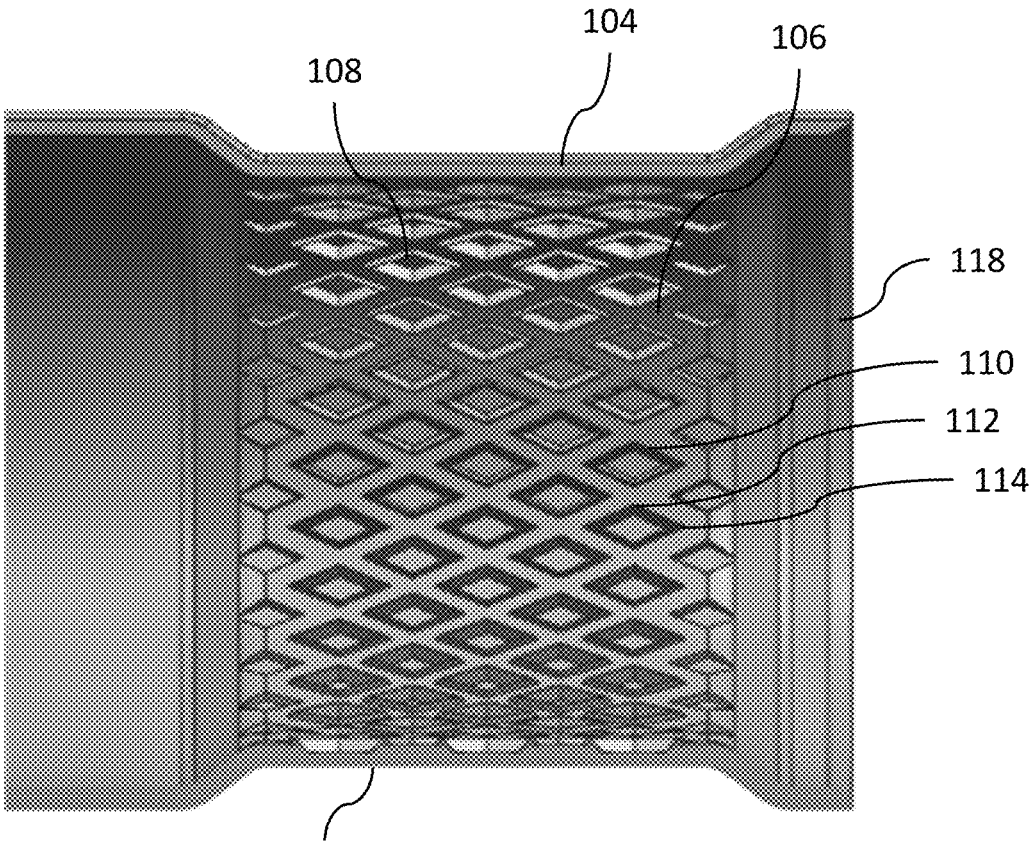
FIG. 3 is a partial cross section view of the shielding electrical terminal of FIG. 1 according to some embodiments.
Figure 4:
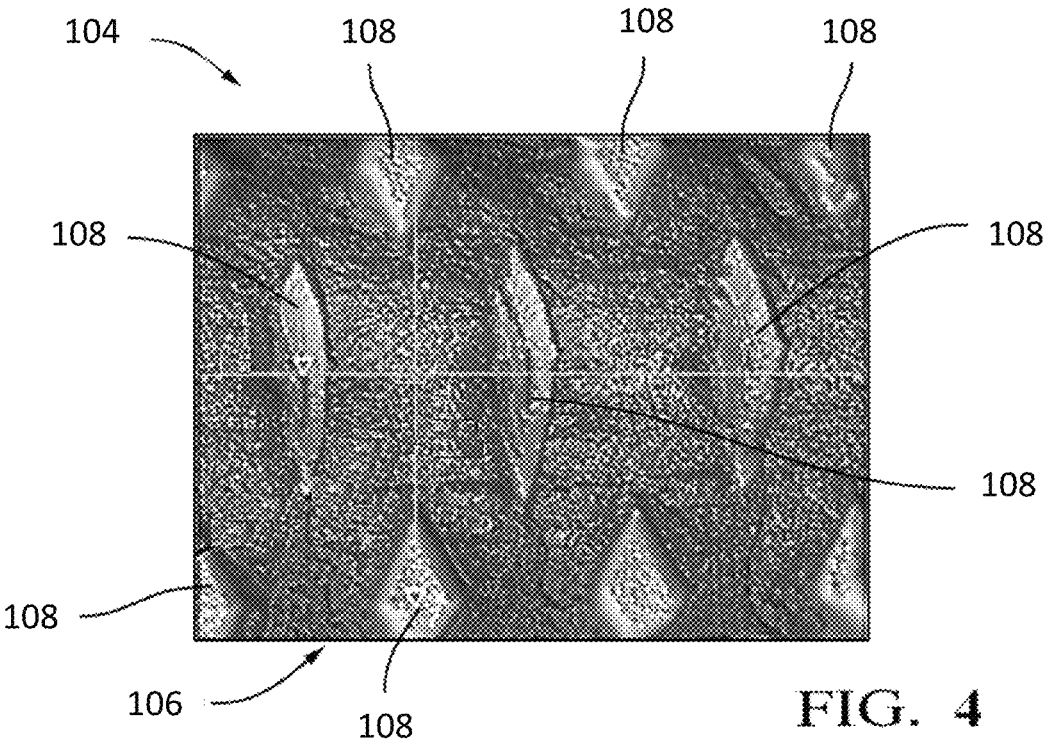
FIG. 4 is a close-up view of knurling on an inner surface of the shielding electrical terminal of FIG. 1 according to some embodiments.
Figure 5:
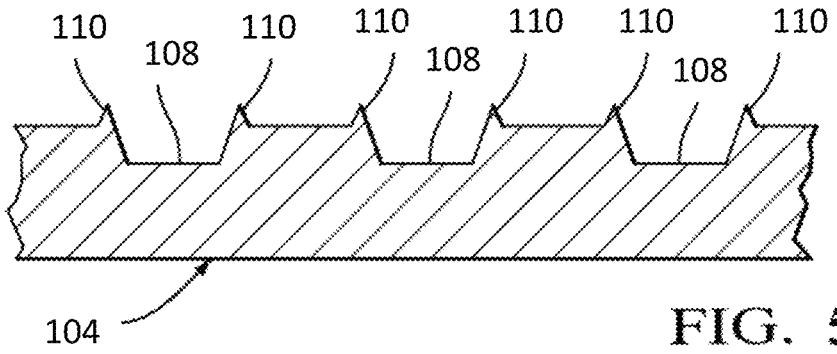
FIG. 5 is a cross section view of the knurling of FIG. 4 according to some embodiments.

In the drawings, different versions of the elements of the various embodiments share the last two digits of the reference numbers.

DETAILED DESCRIPTION

A shielding electrical terminal is described herein and a method of forming such a terminal is described herein. The shielding electrical terminal is an outer shielding terminal configured to be connected to the shield conductor of one shielded cable and an inner shielding terminal that slides within the outer shielding terminal. Rather than having resilient contact arms to provide a contact force between the inner and outer shielding terminals, the outer shielding terminal has pattern of knurled features defining a plurality of protrusions and recesses on an inner surface. When the inner shielding terminal is received within the outer shielding terminal, these protrusions are in an interference fit condition with the inner shielding terminal, thereby providing a number of electrical contact points between the inner and outer shielding connectors.

FIGS. 1 through 5 illustrate a first example of an outer or female shielding electrical terminal, hereinafter referred to as the terminal 100. The terminal has a securing portion 102 defining features that are configured to attach the terminal 100 to a shielded electrical cable (not shown). The terminal 100 also has a mating portion 104 that is mechanically and electrically connected to the securing portion 102. The mating portion 104 has a hollow cylindrical shape and is configured to interconnect with a corresponding mating inner or male shielding electrical terminal 10 that is received within the mating portion 104. The inner surface 106 of the mating portion 104 is knurled to define a plurality of recesses 108, in the illustrated example rhombus-shaped recesses, that are surrounded by a plurality of protrusions 110 extending above the inner surface 106. This plurality of protrusions 110 is formed by the displacement of material caused by the knurling process. The height of the protrusions 110 created by the knurling process is fairly random so that the plurality of protrusions 110 has a nonuniform height. Due to the rhombic shape of the recesses 108, the height of the protrusions 110 above the inner surface 106 vary around the perimeter of the recesses 108 due to more material being displaced near the obtuse angled corners 112 of the recess 108 than at the acute angled corners 114 of the recess 108. The height of the protrusions 110 above the inner surface 106 may also vary due to tolerance variations in the knurling process. The rhombus-shaped recesses 108 are arranged in offset rows and columns such that major axes of the rhombus-shaped recesses are aligned generally parallel to the longitudinal axis X of the terminal 100 and minor axes of the rhombus-shaped recesses are aligned generally perpendicular to the longitudinal axis X of the terminal 100. As used herein "generally" parallel or perpendicular means ±10° of absolutely parallel or perpendicular.

Figure 13:
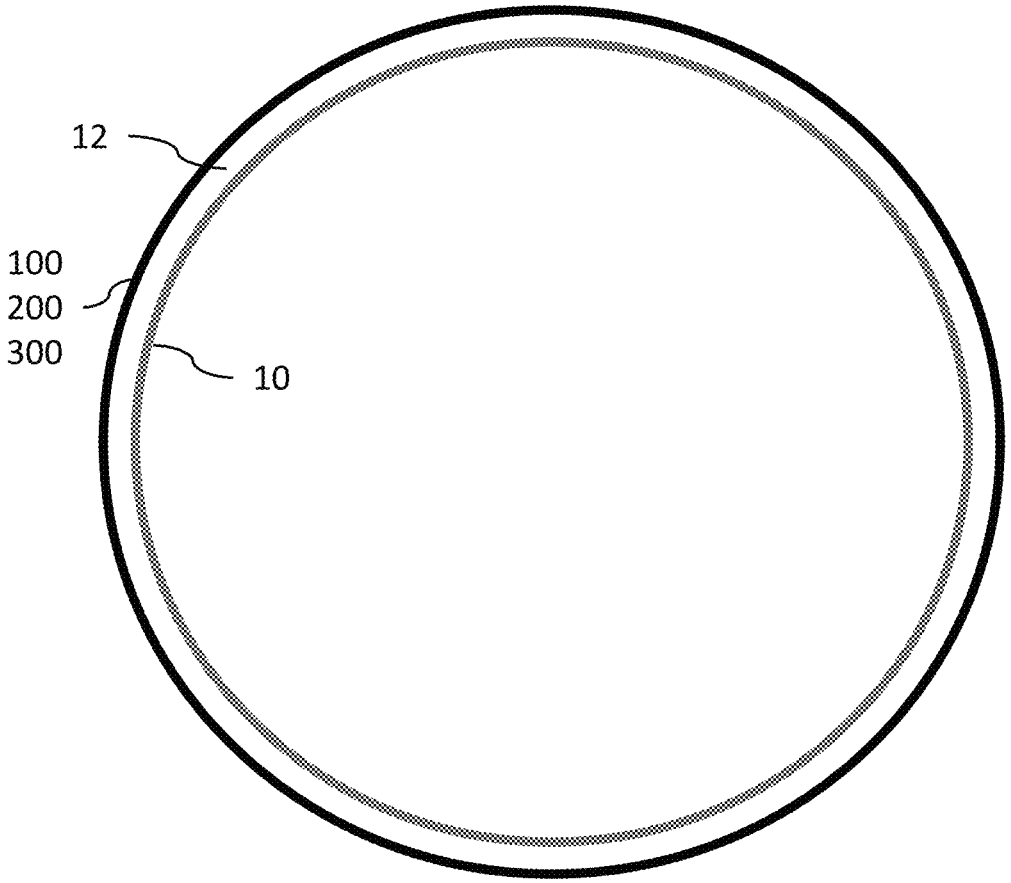
FIG. 13 is a schematic cross section view of the shielding electrical terminal of FIG. 1, 7, or 9 illustrating an air gap between the shielding electrical terminal of FIG. 1, 7, or 9 and a corresponding mating shielding terminal.

When the mating terminal is received within the terminal 100, at least a portion of the protrusions 110 on the inner surface 106 of the terminal are in an interface fit with the outer surface of the mating terminal. The highest protrusions 110 from the inner surface 106 of the terminal 100 are in mechanical and electrical contact with the outer surface of the mating terminal, thereby providing a plurality of electrical connections between the terminal 100 and the mating terminal which lowers the connection resistance and improves shielding efficiency. The protrusions 110 extend from the inner surface 106 at a height by a distance typically between 0.03 and 0.07 mm. As shown in FIG. 13, an air gap 12 between the terminal 100 and the mating terminal 10 is reduced to less than 0.1 mm, preferably less than 0.08 mm, more preferably less than 0.05 mm and even more preferably 0.03 mm, further improving shieling efficiency of the terminal and mating terminal connection. The protrusions 110 having different height also improve resistance of the terminal 100 to fretting corrosion since the higher protrusions 110 that may be degraded by fretting are replaced in contact of protrusions 110 that had an originally lower height than the initial protrusions 110 in contact. The recesses 108 may also serve as a repository for fretting corrosion debris so that the debris does not interfere in the electrical connection between the terminal 100 and the mating terminal.

Each projection in the plurality of projections 110 provides a possible electrical contact point between the mating portion 104 and the corresponding mating terminal. In addition, fretting of one or more of the contact points on the inside surface result in a new electrical contact point being created at a different projection on the inside surface since the height of the protrusions is nonuniform. In this way, fretting does not result in a loss or degradation of electrical contact between the respective terminals. Furthermore, a cost-effective and simple stamping process may be utilized to form the knurling, and hence the plurality of projections 110, so that the formation of the plurality of projections 110 does not add significantly to the cost of the terminal.

In the example illustrated in FIGS. 1-6, an outer wall 116 of the mating portion is continuous, meaning that it does not define any holes, apertures, slits, slots, gaps, breaks, orifices, or openings, etc., except for the opening 118 on the end that receives the mating terminal.

Figure 6:
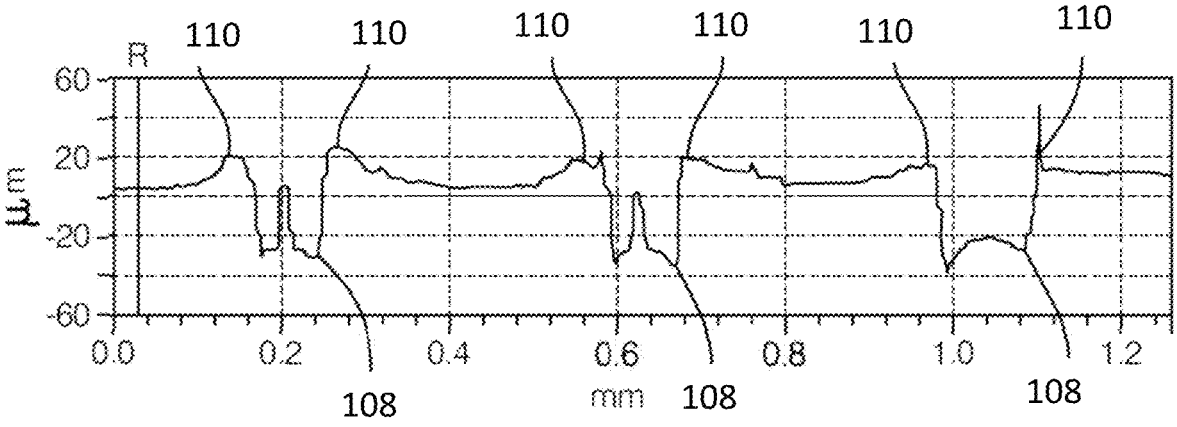
FIG. 6 is a chart illustrating a height of the knurling of FIG. 4 according to some embodiments.

FIG. 6 is a graph illustrating the height of the recesses 108 and protrusions in the mating portion 104 according to some embodiments. The inner surface 106 of the mating portion 104 is assigned a reference height of zero. In some embodiments, the recesses 108 are defined by a depth of approximately negative twenty to negative forty micrometers (μm) and the protrusions 110 are defined by a height of approximately fifteen to twenty-five μm. In some embodiments, the recesses 108 have a depth that is greater than the height of the protrusions 110. In some embodiments, this is a result of the knurling process, in which a press including a patterned die is utilized to form the recesses. The protrusions 110 are formed as a result of the movement of material in formation of the recesses 108. For example, in the embodiment shown in FIG. 6, the protrusions 110 having the greatest height will create the first contact points between the mating portion 104 and the corresponding mating terminal, while the protrusions 110 having lesser heights will not (at least initially) be in contact with the corresponding mating terminal. As the protrusions 110 having the greatest height fret and wear to the point of loss of contact with the mating terminal, protrusions 110 having lesser heights initially will be brought into contact with the mating terminal. In this way, electrical contact is maintained between the mating portion 104 and the corresponding mating terminal despite the occurrence of fretting and wear. It has been observed that forming the plurality of protrusions 110 on the inner surface of the mating portion protects them from being damaged by premature deformation during both the manufacturing process and shipping and handling of the terminal.

Figure 7:
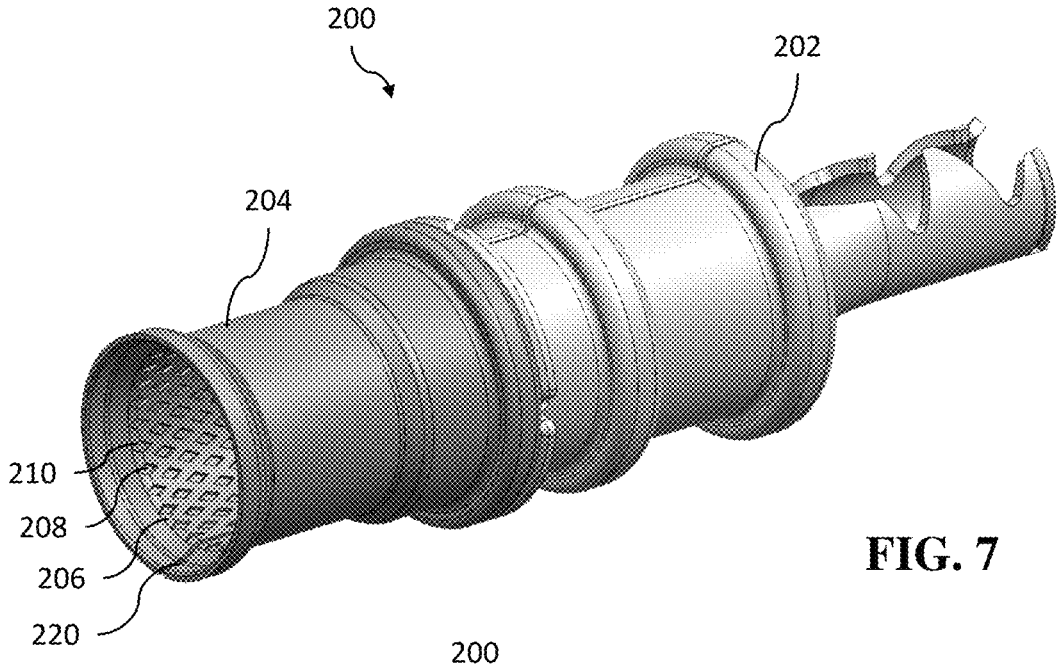
FIG. 7 is a perspective view of a shielding electrical terminal according to some embodiments.
Figure 8:
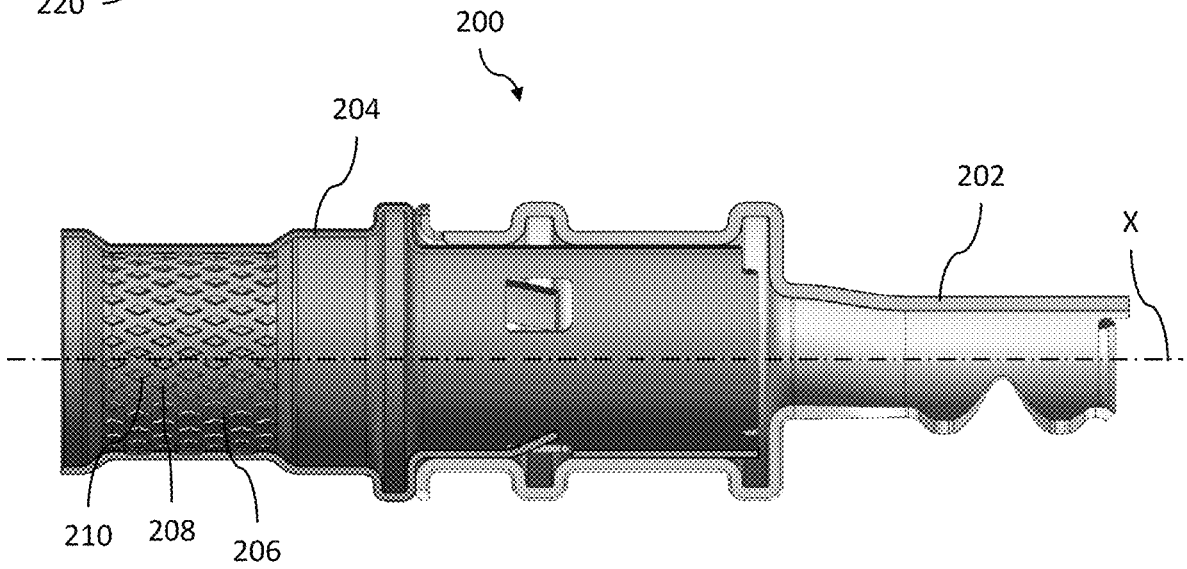
FIG. 8 is a cross section view of the shielding electrical terminal of FIG. 7 according to some embodiments.

FIGS. 7 and 8 illustrate a second example of a shielding electrical terminal 200. In this example the sheet metal forming the mating portion 204 is thinner than the sheet metal forming the securing portion 202 as best shown in FIG. 8. This provides the benefit of a lower insertion force for inserting the corresponding mating terminal within the mating portion 204 due to the lower hoop strength of the mating portion 204 provided by the thinner sheet metal while still providing attachment features in the securing portion 202, e.g., crimping wings as shown in FIGS. 7 and 8, that are thick enough to securely attach the terminal to the shielded cable. The mating portion 204 defines an open-ended axial slit 220 extending parallel to the longitudinal axis X of the terminal 200 from the opening toward the securing portion 202. This open-ended slit 220 decreases the hoop strength of the mating portion 204, thereby reducing the mating engagement force.

Figure 9:
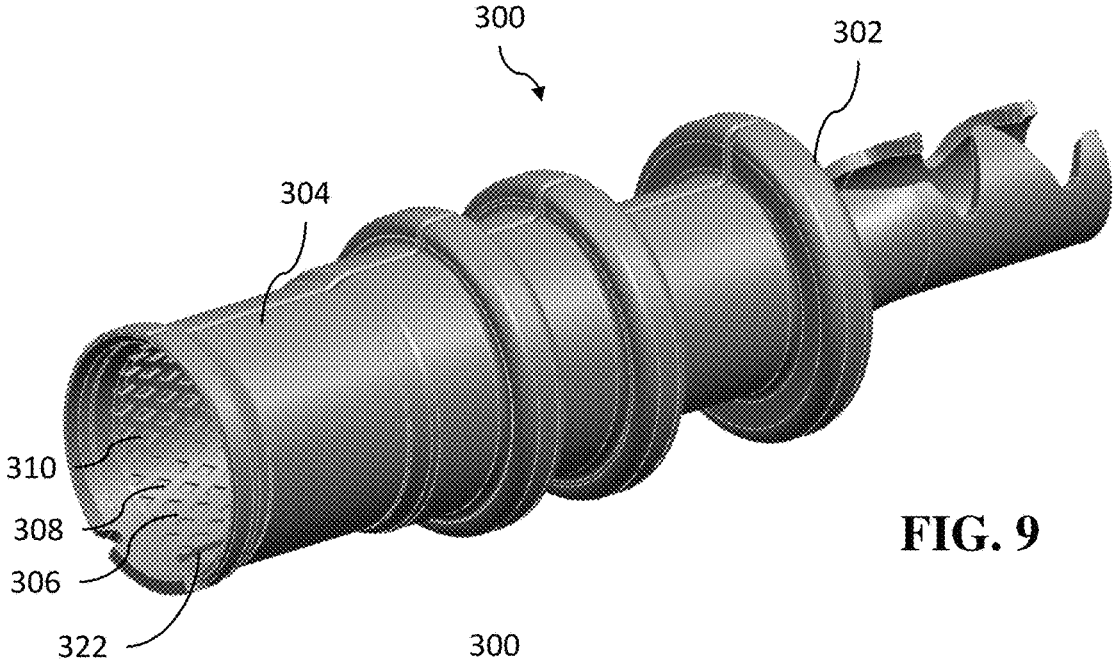
FIG. 9 is a perspective view of a shielding electrical terminal according to some embodiments.
Figure 10:
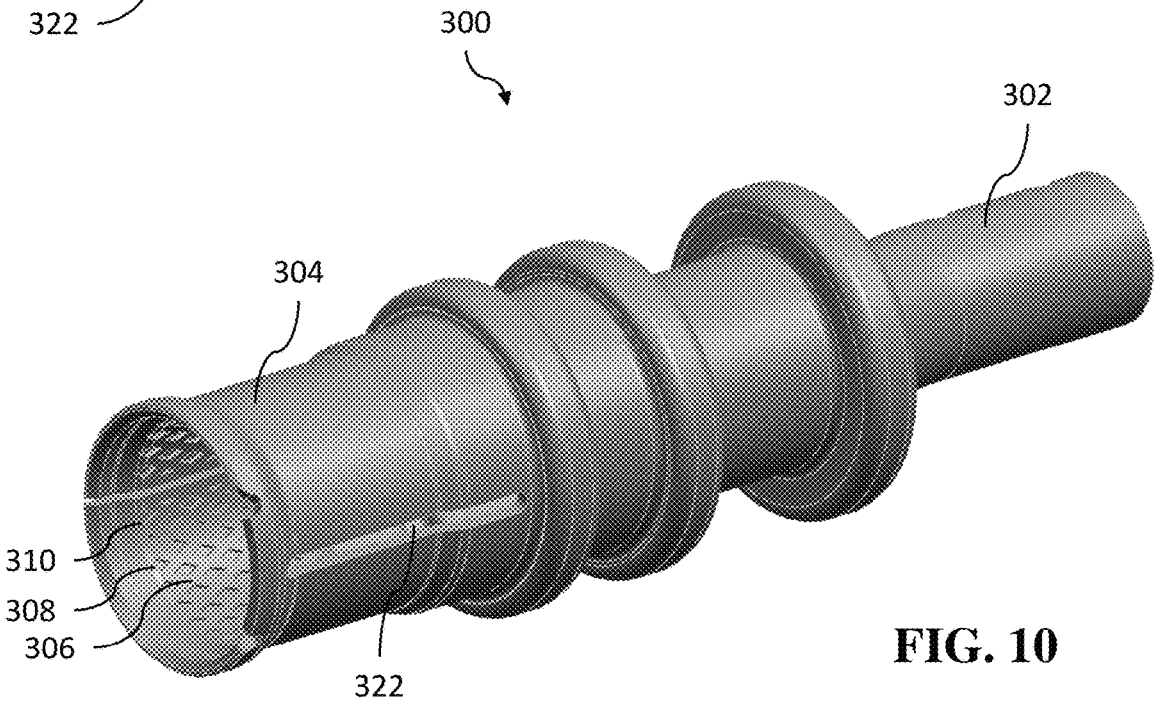
FIG. 10 is an alternate perspective view of the shielding electrical terminal of FIG. 9 rotated approximately 90 degrees about a longitudinal axis according to some embodiments.
Figure 11:
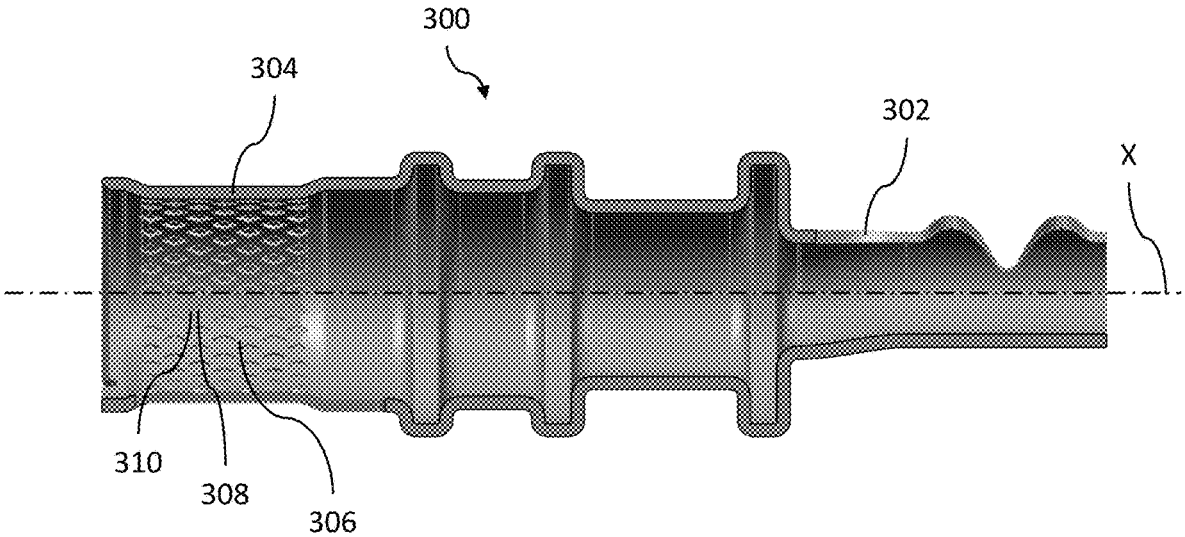
FIG. 11 is a cross section view of the shielding electrical terminal of FIG. 9 according to some embodiments.
Figure 12:
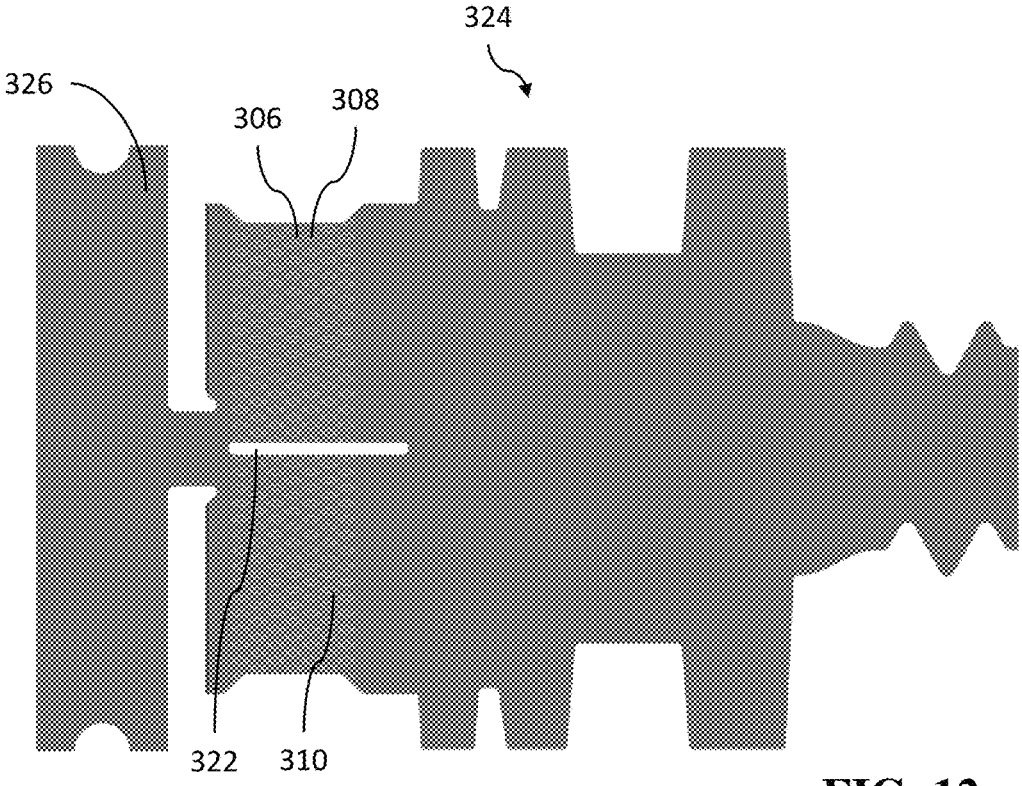
FIG. 12 is a top view of a terminal preform used to form the shielding electrical terminal of FIG. 9 according to some embodiments.

FIGS. 9-11 illustrate a third example of a shielding electrical terminal 300. In this example the mating portion 304 and the securing portion 302 are formed from a single sheet of metal and have the same thickness. The mating portion 304 defines a closed-ended slot 322 in the mating portion 304 extending parallel to the longitudinal axis X of the terminal 300. This closed-ended slot 322 decreases the hoop strength of the mating portion 304, thereby reducing the mating engagement force. A terminal preform 324 for the terminal 300 that is cut from the single piece of sheet metal is shown in FIG. 12. The terminal preform is attached to a tractor strip 326 that is used to handle the terminal preform 324 through the forming processes and later the fully formed terminal 300. The tractor strip is then later removed from the terminal 300.

While the illustrated terminals of FIGS. 1 through 12 are arranged generally parallel or in line with the shielded cables, alternative embodiments of the terminals may be envisioned in which the terminals are generally arranged in at right angle to the cables. In yet other alternative embodiments of the terminal, the securing portion may be configured to be interconnected to conductive traces on a printed circuit board. In addition, while the example terminals illustrated in FIGS. 1-12 have protrusions and recesses that define a rhombic shape, alternative embodiments may have other shaped such as square, rectangular, triangular, round, oval, etc.

Figure 14:
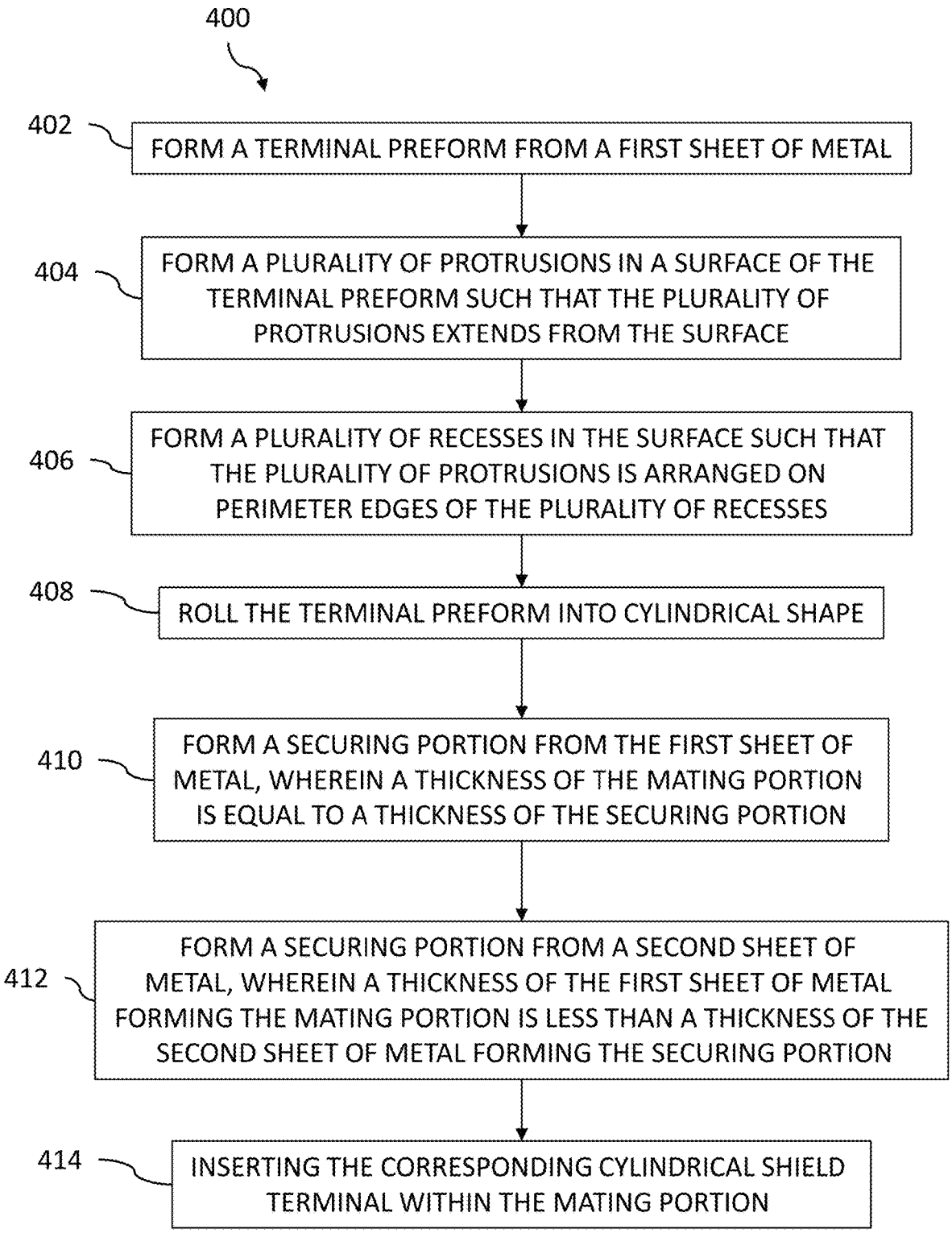
FIG. 14 is a flow chart of a method for forming shielding electrical terminal according to some embodiments.

FIG. 14 shows a flowchart of a method 400 of forming a shielding electrical terminal having a mating portion and a securing portion, such as one of the terminals described above. The method includes the steps of:

Step a), FORM A TERMINAL PREFORM FROM A FIRST SHEET OF METAL 402, includes forming a terminal preform, e.g., 324 from a first sheet of metal;

Step b), FORM A PLURALITY OF PROTRUSIONS IN A SURFACE OF THE TERMINAL PREFORM 404, includes forming a plurality of protrusions 110, 210, 310 in a surface of the terminal preform, e.g., 324 such that the plurality of protrusions extends from the surface.

Step c), ROLL THE TERMINAL PREFORM INTO CYLINDRICAL SHAPE 408, includes rolling the terminal preform, e.g., 324 into cylindrical shape, thereby forming a mating portion 104, 204, 304 which has an inner surface 106, 206, 306 configured to make electrical contact with a corresponding cylindrical male shield terminal inserted within the mating portion 104, 204, 304;

Step d), FORM A PLURALITY OF RECESSES IN THE SURFACE 406 is an optional sub-step of step b) that includes forming a plurality of recesses 108, 208, 308 in the inner surface 106, 206, 306 such that the plurality of protrusions 110, 210, 310 is arranged on perimeter edges of the plurality of recesses 108, 208, 308;

Step e) FORM A SECURING PORTION FROM THE FIRST SHEET OF METAL, WHEREIN A THICKNESS OF THE MATING PORTION IS EQUAL TO A THICKNESS OF THE SECURING PORTION 410, is an optional step that includes forming a securing portion 302 from the first sheet of metal, wherein a thickness of the mating portion 304 is equal to a thickness of the securing portion 302. The securing portion 302 is then attached to the mating portion 304 formed in step c);

Step f), FORM A SECURING PORTION FROM A SECOND SHEET OF METAL, WHEREIN A THICKNESS OF THE FIRST SHEET OF METAL FORMING THE MATING PORTION IS LESS THAN A THICKNESS OF THE SECOND SHEET OF METAL FORMING THE SECURING PORTION 412 is an optional step that includes forming a securing portion 202 from a second sheet of metal, wherein a thickness of the first sheet of metal forming the mating portion 204 is less than a thickness of the second sheet of metal forming the securing portion 202. The securing portion 202 is then attached to the mating portion 204 formed in step c); and Step g), INSERTING THE CORRESPONDING CYLINDRICAL SHIELD TERMINAL WITHIN THE MATING PORTION 414 is an optional step that includes inserting the corresponding cylindrical shield terminal 100, 200, 300 within the mating portion, wherein the plurality of protrusions 110, 210, 310 is sized, shaped, and arranged to minimize an air gap 12 formed between the inner surface 106, 206, 306 of the mating portion 104, 204, 304 and the corresponding cylindrical shield terminal 10.

Accordingly, a shielding electrical terminal and a method of manufacturing such a shielding electrical terminal is provided. The terminal and the method provide the benefits over the prior art shielding terminals of improved shielding efficiency due to a lower connection resistance and reduced air gap between the terminal and the mating terminal. The terminal and the method also provide improve resistance of the terminal to fretting corrosion. The terminal and the method further provide a terminal with reduced mating force requirements to interconnect the terminal with the mating terminal, thereby improving ergonomics for the process of connecting the terminal with the mating terminal.

While the invention has been described with reference to an exemplary embodiment(s), it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the disclosed embodiment(s), but that the invention will include all embodiments falling within the scope of the appended claims.

The invention claimed is:

1. A shielding electrical terminal, comprising:

a securing portion configured to attach the shielding electrical terminal to an outer shield conductor of a shielded cable; and a cylindrical mating portion having an inner surface configured to make electrical contact with a corresponding cylindrical shield terminal inserted within the mating portion, wherein the inner surface defines a plurality of protrusions extending from the inner surface, wherein the plurality of protrusions is sized, shaped, and arranged to minimize an air gap formed between the inner surface of the mating portion and the corresponding cylindrical shield terminal when inserted within the mating portion.

2. The shielding electrical terminal according to claim 1, wherein the plurality of protrusions is non-uniform in height.

3. The shielding electrical terminal according to claim 1, wherein the inner surface defines a knurled surface having a plurality of recesses and wherein the plurality of protrusions is arranged on perimeter edges of the plurality of recesses.

4. The shielding electrical terminal according to claim 3, wherein each recess in the plurality of recesses is rhombus shaped.

5. The shielding electrical terminal according to claim 4, wherein major axes of the plurality of rhombus shaped recesses are aligned generally parallel to a longitudinal axis of the shielding electrical terminal and wherein minor axes of the plurality of rhombus shaped recesses are aligned generally perpendicular to the longitudinal axis of the shielding electrical terminal.

6. The shielding electrical terminal according to claim 1, wherein an outer wall of the mating portion is continuous and does not define an aperture extending therethrough.

7. The shielding electrical terminal according to claim 1, wherein an outer wall of the mating portion defines an axial slit aligned parallel to a longitudinal axis of the shielding electrical terminal.

8. The shielding electrical terminal according to claim 7, wherein the mating portion and the securing portion are formed of a sheet of metal and wherein a thickness of the sheet of metal forming the mating portion is equal to a thickness of the sheet of metal forming the securing portion.

9. The shielding electrical terminal according to claim 1, wherein the mating portion is formed from a first sheet of metal and the securing portion is formed of a second sheet of metal and wherein a thickness of the first sheet of metal is less than a thickness of the second sheet of metal.

10. A method of forming a shielding electrical terminal having a mating portion configured to make electrical contact with a corresponding cylindrical shield terminal inserted within the mating portion and a securing portion configured to attach the shielding electrical terminal to an outer shield conductor of a shielded cable, the method comprising:

a) forming a terminal preform from a first sheet of metal;

b) forming a plurality of protrusions in a surface of the terminal preform such that the plurality of protrusions extends from the surface;

c) rolling the terminal preform into cylindrical shape, thereby forming the mating portion which has an inner surface configured to make electrical contact with a corresponding cylindrical male shield terminal inserted within the mating portion, wherein the surface is the inner surface of mating portion; and d) inserting the corresponding cylindrical shield terminal within the mating portion, wherein the plurality of protrusions is sized, shaped, and arranged to minimize an air gap formed between the inner surface of the mating portion and the corresponding cylindrical shield terminal.

11. The method according to claim 10, wherein the plurality of protrusions is formed such that it is non-uniform in height.

12. The method according to claim 10, wherein step b), forming a plurality of protrusions in a surface of the terminal preform such that the plurality of protrusions extends from the surface, further comprises:

e) forming a plurality of recesses in the surface such that the plurality of protrusions is arranged on perimeter edges of the plurality of recesses.

13. The method according to claim 12, wherein the plurality of protrusions and the plurality of recesses are formed using a knurling process.

14. The method according to claim 13, wherein each recess in the plurality of recesses is rhombus shaped, wherein the plurality of recesses is formed such that major axes of the plurality of rhombus shaped recesses are generally aligned parallel to a longitudinal axis of the shielding electrical terminal, and wherein the plurality of recesses is formed such that minor axes of the plurality of rhombus shaped recesses are aligned generally perpendicular to a longitudinal axis of the shielding electrical terminal.

15. The method according to claim 10, wherein an outer wall of the mating portion is continuous and does not define an aperture extending therethrough.

16. The method according to claim 10, wherein an outer wall of the mating portion defines an axial slit aligned parallel to a longitudinal axis of the shielding electrical terminal.

17. The method according to claim 16, further comprising:

f) forming a securing portion from the first sheet of metal, wherein a thickness of the mating portion is equal to a thickness of the securing portion.

18. The method according to claim 10, further comprising:

g) forming a securing portion from a second sheet of metal, wherein a thickness of the first sheet of metal forming the mating portion is less than a thickness of the second sheet of metal forming the securing portion.

* * * * *